US005291936A

United States Patent [19]

Rommel et al.

[11] Patent Number: 5,291,936

[45] Date of Patent: Mar. 8, 1994

[54] METHOD AND APPARATUS FOR PRODUCING MOLD PARTS FOR FOUNDRIES

[75] Inventors: Reiner Rommel, Brühl; Werner Landua, Mannheim, both of Fed. Rep. of Germany

[73] Assignee: Adolf Hottinger Maschinenbau GmbH, Mannheim, Fed. Rep. of Germany

[21] Appl. No.: 782,587

[22] Filed: Oct. 25, 1991

[30] Foreign Application Priority Data

Oct. 25, 1990 [DE] Fed. Rep. of Germany ..... 4033887

[51] Int. Cl.[5] ..... B22C 15/26

[52] U.S. Cl. ..... 164/22; 164/27; 164/28; 164/200

[58] Field of Search ..... 164/18, 19, 20, 21, 164/22, 27, 28, 200

[56] References Cited

U.S. PATENT DOCUMENTS 5,014,766 5/1991 Weber ..... 164/200 X

FOREIGN PATENT DOCUMENTS 2461539 3/1981 France ..... 164/200
50-17294 6/1975 Japan ..... 164/200
1-299743 12/1989 Japan ..... 164/200

*Primary Examiner*—J. Reed Batten, Jr.
*Attorney, Agent, or Firm*—Antonelli, Terry, Stout & Kraus

[57] ABSTRACT

The apparatus includes a mold unit for at least two mold parts, with in each case at least two separate shooting heads and sand magazines with separate shooting hood shoot-out areas and in which the shooting heads are subject to the action of individual shooting air sources. In the method a unit with mold cavities for at least two mold parts to be interconnected is moved under a shooting station, which is provided with at least two shooting heads and sand magazines with separate shooting hood shoot-out areas and from the magazines sand is shot into the mold unit cavities for the different mold parts with different pressures and different sand compositions.

11 Claims, 2 Drawing Sheets

METHOD AND APPARATUS FOR PRODUCING MOLD PARTS FOR FOUNDRIES

BACKGROUND OF THE INVENTION

The invention relates to an apparatus and a method for producing mold parts for foundries.

Mold parts, such as sand core or mask parts or the like for foundries, which are generally interconnected, e.g., assembled, in order to provide a complete sand mold, such as a sand core or mask mold, are generally produced so close together as regards time and space, that they can be automatically interconnected immediately after production, this requires high manufacturing precision with a view to automatic connection.

An object of the invention is to provide an apparatus and a method for producing such mold parts which, whilst achieving the aforementioned objectives, improves the production process or permits production using foundry-specific, different molding materials, as well as the associated molding material-specific processing parameters and in particular makes it possible to reduce labor and time costs.

SUMMARY OF THE INVENTION

For achieving this object the invention comprises an apparatus for producing mold parts for foundries, such as sand cores, masks, etc. with a mold unit for at least two mold parts, with in each case at least two shooting heads and sand magazines with separate shooting dome shoot-out areas, in which the shooting heads are in each case exposed to their own shooting air sources. This invention also includes a method for producing mold parts for foundry purposes, such as sand cores, masks or the like, in which a mold with mold cavities for at least two mold parts to be interconnected is moved under a shooting station, which in each case has at least two shooting heads and sand magazines with separate shooting dome shoot-out areas and in which from the magazines sand is shot into the mold unit cavities for the different mold parts at a different pressure and with a different sand composition.

Thus, according to the invention, a mold unit is provided, in which it is possible to simultaneously produce preferably two and optionally several sand mold parts and preferably those mold parts which are interconnected for forming the overall mold are, e.g., assembled. The invention provides the prerequisite for automatic assembly because, on the one hand, the mold parts are made available in a closely adjacent manner and can, on the other hand, be accurately adapted to one another. The invention is particularly advantageous if the mold parts to be produced are relatively small, so that the production of each individual mold part in its own mold would require a large number of working processes and therefore increase labor and time coats. It is important that the inventive apparatus is provided in a common shooting dome with different shoot-out areas and optionally a common shooting plate for each mold part with its own shooting air source. As a result, it is possible to operate with the maximum, but different operating pressures. There are mold parts in which a lower working pressure is required for production. If working then took place with a higher working pressure, because this was made necessary by another mold part, then increased wear could occur, which can be reduced by the possibility of adapting the shooting air pressure so that, in a preferred development, the sand magazine can be subject to different pressures by means of the shooting heads.

According to another preferred development several sand bunkers are arranged in such a way that the sand magazines can be filled separately, but simultaneously therefrom. This makes it possible to work with different sand types, which can be adapted to corresponding mold parts. According to a further development, level sensors are located at different heights in the sand magazines. As a result, for the individual mold parts, different sand quantities can be filled into the sand magazines rather than only the same quantities, which would in principle only permit the production of identical mold parts or mold parts with the same volume in a single mold unit. The shooting air sources associated with the corresponding mold parts also allow different shooting times.

According to further preferred developments of the method, the sand can be filled from different sand bunkers to different heights in interconnected sand magazines and the sand can be blown with different shooting times into the mold unit cavities for the mold parts.

The invention provides a variable solution for complicated mold parts, i.e., complicated sand cores and masks, accompanied by the individual setting of the filling level of the molding materials in the shooting unit prior to shooting. The invention also offers shorter sand paths and, therefore, a better and greater compression of the mold parts. Compared with known apparatus it is possible to reduce the shooting pressures, which once again increases the service life of the molds.

BRIEF DESCRIPTION OF THE DRAWINGS

The invention is described in greater detail hereinafter relative to a non-limitative embodiment an the attached drawings diagrammatically showing apparatus according to the invention in which.

DETAILED DESCRIPTION OF THE PREFERRED EMBODIMENTS

Figure 1:
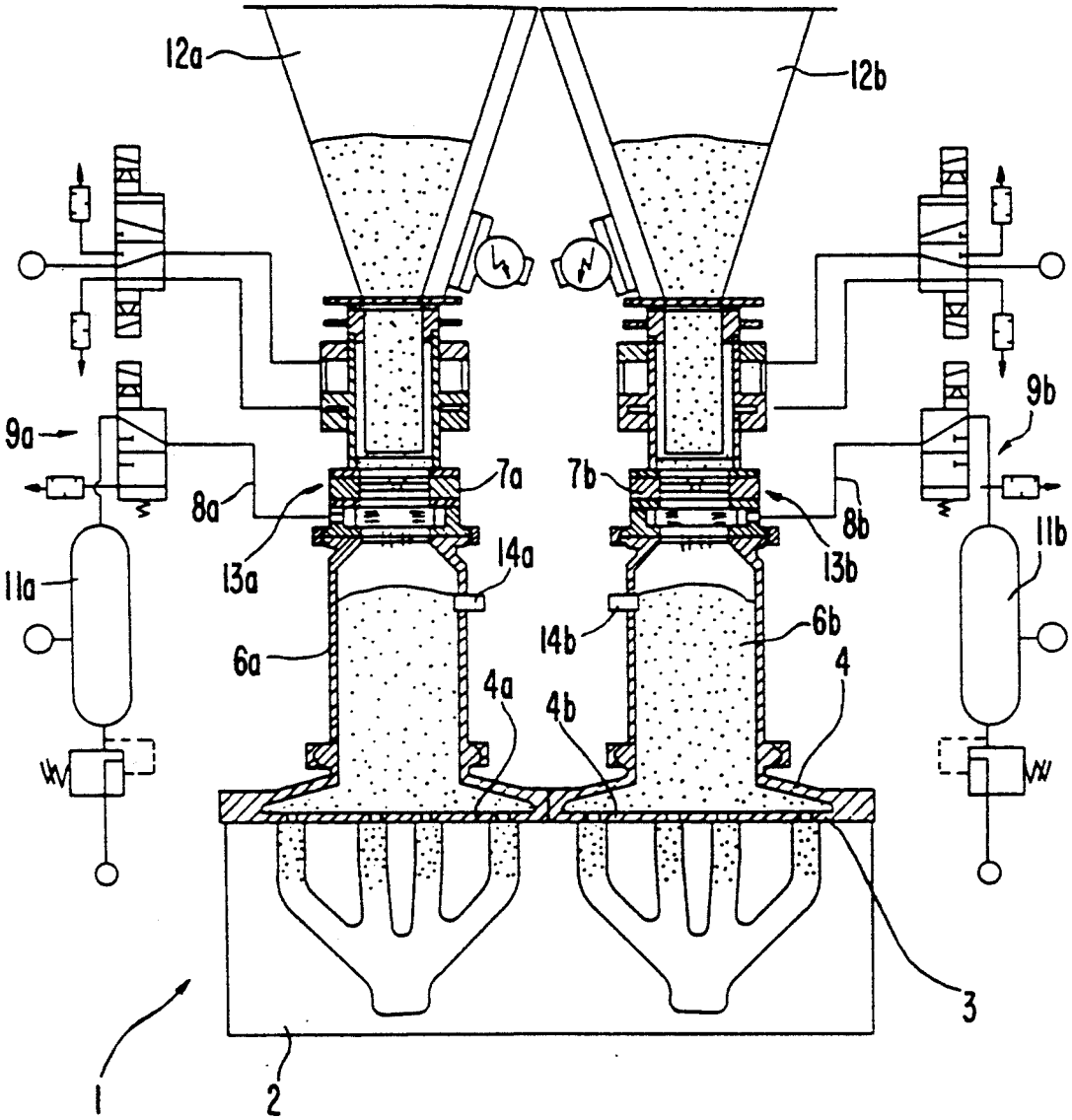
FIG. 1 shows a first embodiment of the apparatus of the present invention wherein the apparatus has two common shooting plates.
Figure 2:
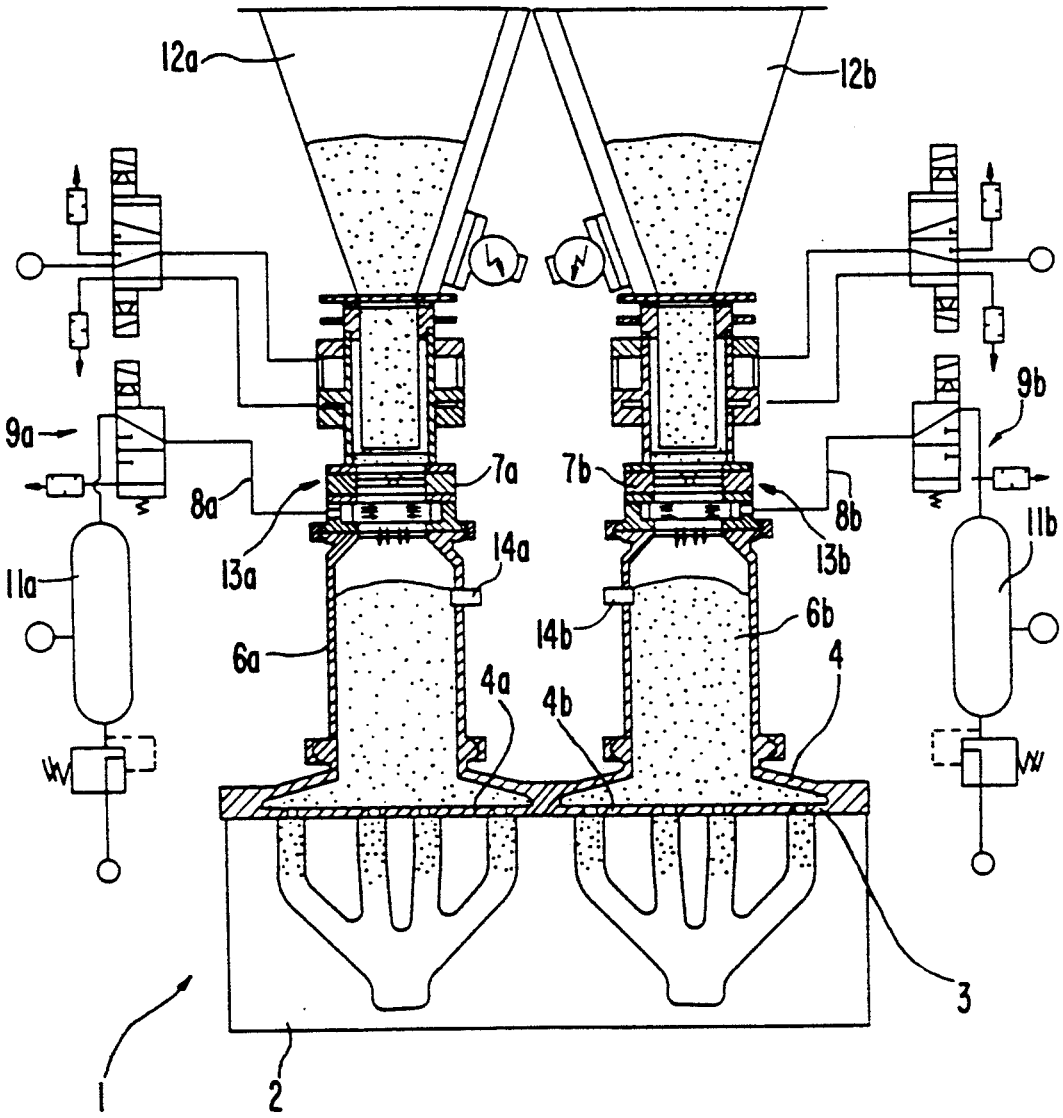
FIG. 2 shows a second embodiment of the apparatus of the present invention wherein the apparatus include a common shooting plate.

As shown in FIGS. 1 and 2, the inventive apparatus 1 for producing mold parts, such as cores and masks for foundry purposes, has a common mold unit 2 for the corresponding mold parts. The mold unit can be formed by a horizontally split upper mold and lower mold, or a vertically split mold front part and mold rear part, which are firmly interconnected on filling and jointly movable. In such a mold unit it is, e.g., simultaneously possible to produce two mold or core parts of a mold to be produced therefrom and optionally, further parts in which subsequently the corresponding workpiece will be cast. Thus, in the mold unit 2, it is, e.g., possible to simultaneously produce the water jacket core and bottom core of an internal combustion engine.

For shooting in the sand, the cavities of the mold 2 are connected by means of a common shooting plate 3 in a common shooting hood 4 with two separate shoot-out areas 4*a*, 4*b* with separate and independent sand magazines 6*a*, 6*b* associated with the latter. The shoot-out areas 4*a*, 4*b* may be provided with two common shooting plates 3 as shown in FIG. 1 or with a single common shooting plate as shown in FIG. 2. Each of the sand magazines 6a, 6b is provided with a shooting head 7a, 7b, which is in each case connected by means of a compressed air line 8a, 8b via valves 9a, 9b to a compressed air volume or reservoir 11a, 11b. Above the shooting head 7a, 7b are provided sand bunkers 12a, 12b from which the sand supply to the sand magazines 6a, 6b can be controlled by means of cut-out members 13a, 13b. On the sand magazines 6a, 6b are provided level sensors 14a, 14b, which can be located at different heights and control the cut-out members 13a, 13b.

From the sand bunkers 12a, 12b, and as a function of the different requirements in connection with the production of the mold or core parts, different sand types, e.g. coarser or less coarse sand can be filed into the sand magazines 6a, 6b with optionally different quantities in accordance with the individual mold parts to be formed for producing the overall mold. On reaching the desired quantity, which is established by the level sensors 14a, 14b, the shut-off members 13a, 13b are shut off.

Parallel thereto, the compressed air reservoirs 11a, 11b are brought to the desired and, optionally different, pressure. The valves 9a, 9b are then opened. The compressed air under high pressure in the reservoirs 11a, 11b passes via the shooting heads 7a, 7b into the sand magazines 6a, 6b and drives the sand located therein via the corresponding shoot-out areas 4a, 4b of the common shooting hood 4 and the shooting plate 3 with different shooting pressures into the cavities of the mold unit 2.

We claim:

1. An apparatus for producing mold parts for foundries, comprising:

a mold unit having at least two cavities for forming at least two mold parts;

a common shooting hood having at least two shoot-out areas arranged adjacent one another;

a first sand magazine;

a first shooting head for shooting sand from said first sand magazine to a first one of said at least two shoot-out areas;

a first shooting air source for supplying air to said first shooting head;

a second sand magazine;

a second shooting head for shooting sand from said second sand magazine to a second of said at least two shoot-out areas;

a second shooting air source for supplying air to said second shooting head;

wherein said at least two shoot-out areas are arranged adjacent one another such that each of said at least two shoot-out areas is supplied with sand from a respective one of said first and second sand magazines and ejects sand vertically downwardly into a respective one of said at least two cavities of said mold unit.

2. Apparatus according to claim 1, further comprising first and second sand bunkers arranged in such a way that the respective first and second sand magazine can be separately, but simultaneously filled therefrom.

3. Apparatus according to claim 2, further comprising first and second level sensors located at different levels in the respective first and second sand magazines to enable the first and second sand magazines to process different sand quantities.

4. Apparatus according to claim 2, further comprising means for exposing the first and second sand magazines to different pressures by means of the first and second shooting heads, respectively.

5. Apparatus according to claim 1, wherein the at least two shoot-out areas are provided on their underside with at most two common shooting plates.

6. Apparatus according to claim 5, wherein the at least two shoot-out areas are provide with a common shooting plate.

7. Apparatus according to claim 1, further comprising first and second level sensors located at different levels in the respective first and second sand magazines to enable the first and second sand magazines to process different sand quantities.

8. Apparatus according to claim 1, further comprising means for exposing the first and second sand magazines to different pressures by means of the first and second shooting heads, respectively.

9. A method for producing a plurality of mold parts for foundries, comprising:

moving a mold unit having at least two cavities therein under a common shooting hood having at least two shoot-out areas arranged adjacent to one another, wherein each of said at least two shoot-out areas is supplied with sand from a respective zone of first and second sand magazines, each of said first and second sand magazines being provided with a respective one of first and second shooting heads for shooting sand therefrom;

shooting sand vertically downwardly into a first one of said at least two cavities in said mold unit from a respective first one of said at least two shoot-out areas at a first pressure and a first sand composition; and shooting sand vertically downwardly into a second one of said at least two cavities in said mold unit from a second one of said at least two shoot-out areas at a second pressure and a second sand composition;

wherein said first pressure and said first sand composition are different than said second pressure and second sand composition, respectively.

10. Method according to claim 9, further comprising filling said sand compositions in said first and second magazines to different heights from different sand bunkers.

11. Method according to claim 9, wherein said is shot with different shooting times into respective ones of the at least two cavities.

* * * * *

UNITED STATES PATENT AND TRADEMARK OFFICE

CERTIFICATE OF CORRECTION

PATENT NO. : 5,291,936

DATED : March 8, 1994

INVENTOR(S) : ROMMEL, et al

It is certified that error appears in the above-indentified patent and that said Letters Patent is hereby corrected as shown below:

In column 4, Claim 11, line 1,

"Method according to claim 9, wherein said is shot"

should read:

--Method according to claim 9, wherein said sand is shot--

Signed and Sealed this

Seventeenth Day of March, 1998

*Attest:*

*Attesting Officer*

BRUCE LEHMAN

*Commissioner of Patents and Trademarks*